US010473329B2

(12) United States Patent
Vorlicek et al.

(10) Patent No.: US 10,473,329 B2
(45) Date of Patent: Nov. 12, 2019

(54) FLAME SENSE CIRCUIT WITH VARIABLE BIAS

(71) Applicant: Honeywell International Inc., Morris Plains, NJ (US)

(72) Inventors: Jan Vorlicek, Stepanovice (CZ); Jiri Kastan, Brno (CZ)

(73) Assignee: Honeywell International Inc., Morris Plains, NJ (US)

( * ) Notice: Subject to any disclaimer, the term of this patent is extended or adjusted under 35 U.S.C. 154(b) by 167 days.

(21) Appl. No.: 15/853,047

(22) Filed: Dec. 22, 2017

(65) Prior Publication Data

US 2019/0195493 A1 Jun. 27, 2019

(51) Int. Cl.

| | |
|---|---|
| ***F23N 5/12*** | (2006.01) |
| ***F23N 5/24*** | (2006.01) |
| *G08B 17/12* | (2006.01) |

(52) U.S. Cl.

CPC ..... *F23N 5/123* (2013.01); *F23N 5/242* (2013.01); *F23N 2023/08* (2013.01); *F23N 2029/12* (2013.01); *G08B 17/12* (2013.01)

(58) Field of Classification Search

CPC ..... F23N 5/12; F23N 5/24; F23N 2023/08; G05B 17/12

USPC ..... 431/24

See application file for complete search history.

(56) References Cited

U.S. PATENT DOCUMENTS

| | | | | |
|---|---|---|---|---|
| 3,425,780 A | | 2/1969 | Potts | |
| 3,520,645 A | | 7/1970 | Cotton et al. | |
| 3,649,156 A | | 3/1972 | Conner | |
| 3,681,001 A | | 8/1972 | Potts | |
| 3,836,857 A | | 9/1974 | Ikegami et al. | |
| 3,909,816 A | | 9/1975 | Teeters | |
| 4,035,134 A | * | 7/1977 | Matthews | F23N 5/203 431/21 |
| 4,157,506 A | | 6/1979 | Spencer | |
| 4,221,557 A | | 9/1980 | Jalics | |
| 4,242,079 A | | 12/1980 | Matthews | |
| 4,269,589 A | | 5/1981 | Matthews | |
| 4,280,184 A | | 7/1981 | Weiner et al. | |
| 4,303,385 A | | 12/1981 | Rudich et al. | |
| 4,370,557 A | | 1/1983 | Axmark et al. | |
| 4,450,499 A | | 5/1984 | Sorelle | |
| 4,457,692 A | | 7/1984 | Erdman | |

(Continued)

FOREIGN PATENT DOCUMENTS

| | | |
|---|---|---|
| EP | 0967440 A2 | 12/1999 |
| EP | 1148298 B1 | 10/2004 |
| WO | 9718417 A1 | 5/1997 |

OTHER PUBLICATIONS

Honeywell, "S4965 Series Combined Valve and Boiler Control Systems," 16 pages, prior to Jul. 3, 2007.

(Continued)

*Primary Examiner* — Gregory L Huson
*Assistant Examiner* — Nikhil P Mashruwala

(57) ABSTRACT

A system for changing a bias level of a flame sensing circuit to identify leakage in the flame sensing circuit. The bias level may be varied in the positive or negative axis and the flame current may be noted to identify leakage. The bias level may be changed by a microcontroller. The bias level may be changed using an operational amplifier configuration which is used as a signal conditioner for interfacing the flame signal to the microcontroller.

8 Claims, 2 Drawing Sheets

(56) References Cited

U.S. PATENT DOCUMENTS 4,483,672 A 11/1984 Wallace et al.
4,521,825 A 6/1985 Crawford
4,527,247 A 7/1985 Kaiser et al.
4,555,800 A 11/1985 Nishikawa et al.
4,622,005 A 11/1986 Kuroda
4,626,193 A 12/1986 Gann
4,655,705 A 4/1987 Shute et al.
4,672,324 A 6/1987 van Kampen
4,695,246 A 9/1987 Beilfuss et al.
4,709,155 A 11/1987 Yamaguchi et al.
4,777,607 A 10/1988 Maury et al.
4,830,601 A 5/1989 Dahlander et al.
4,842,510 A 6/1989 Grunden et al.
4,843,084 A 6/1989 Parker et al.
4,872,828 A 10/1989 Mierzwinski et al.
4,904,986 A 2/1990 Pinckaers
4,949,355 A 8/1990 Dyke et al.
4,955,806 A 9/1990 Grunden et al.
5,026,270 A 6/1991 Adams et al.
5,026,272 A 6/1991 Takahashi et al.
5,037,291 A 8/1991 Clark
5,073,769 A 12/1991 Kompelien
5,077,550 A 12/1991 Cormier
5,112,117 A 5/1992 Altmann et al.
5,126,721 A 6/1992 Butcher et al.
5,158,477 A 10/1992 Testa et al.
5,175,439 A 12/1992 Haerer et al.
5,222,888 A 6/1993 Jones et al.
5,236,328 A 8/1993 Tate et al.
5,255,179 A 10/1993 Zekan et al.
5,276,630 A 1/1994 Baldwin et al.
5,280,802 A 1/1994 Comuzie, Jr.
5,300,836 A 4/1994 Cha
5,347,982 A 9/1994 Binzer et al.
5,365,223 A * 11/1994 Sigafus ..... F23N 5/082 340/578
5,391,074 A 2/1995 Meeker
5,424,554 A 6/1995 Marran et al.
5,446,677 A 8/1995 Jensen et al.
5,472,336 A 12/1995 Adams et al.
5,506,569 A 4/1996 Rowlette
5,567,143 A 10/1996 Servidio
5,599,180 A 2/1997 Peters et al.
5,682,329 A 10/1997 Seem et al.
5,722,823 A 3/1998 Hodgkiss
5,797,358 A 8/1998 Brandt et al.
5,971,745 A 10/1999 Bassett et al.
6,013,919 A * 1/2000 Schneider ..... F23N 5/082 250/554
6,060,719 A 5/2000 DiTucci et al.
6,071,114 A 6/2000 Cusack et al.
6,084,518 A 7/2000 Jamieson
6,222,719 B1 4/2001 Kadah
6,261,086 B1 7/2001 Fu
6,299,433 B1 10/2001 Gauba et al.
6,346,712 B1 2/2002 Popovic et al.
6,349,156 B1 2/2002 O'Brien et al.
6,356,827 B1 3/2002 Davis et al.
6,385,510 B1 5/2002 Hoog et al.
6,457,692 B1 10/2002 Gohl
6,474,979 B1 11/2002 Rippelmeyer
6,486,486 B1 11/2002 Haupenthal
6,509,838 B1 1/2003 Payne et al.
6,552,865 B2 4/2003 Cyrusian
6,676,404 B2 1/2004 Lochschmied
6,743,010 B2 6/2004 Bridgeman et al.
6,782,345 B1 8/2004 Siegel et al.
6,794,771 B2 9/2004 Orloff
6,912,671 B2 6/2005 Christensen et al.
6,917,888 B2 7/2005 Logvinov et al.
6,923,640 B2 8/2005 Canon
7,088,137 B2 8/2006 Behrendt et al.
7,088,253 B2 8/2006 Grow
7,202,794 B2 4/2007 Huseynov et al.
7,241,135 B2 7/2007 Munsterhuis et al.
7,255,284 B2 8/2007 Kim et al.
7,255,285 B2 8/2007 Troost et al.
7,274,973 B2 9/2007 Nichols et al.
7,289,032 B2 10/2007 Seguin et al.
7,327,269 B2 2/2008 Kiarostami
7,617,691 B2 11/2009 Street et al.
7,728,736 B2 6/2010 Leeland et al.
7,764,182 B2 * 7/2010 Chian ..... F23N 5/123 340/577
7,768,410 B2 8/2010 Chian
7,800,508 B2 * 9/2010 Chian ..... F23N 5/123 340/577
7,806,682 B2 10/2010 Cueva
8,066,508 B2 11/2011 Nordberg et al.
8,085,521 B2 * 12/2011 Chian ..... F23N 5/123 361/253
8,300,381 B2 10/2012 Chian et al.
8,310,801 B2 11/2012 McDonald et al.
8,659,437 B2 2/2014 Chian
8,875,557 B2 11/2014 Chian et al.
9,784,449 B2 * 10/2017 Margolin ..... F23N 5/123
10,151,492 B2 * 12/2018 Huang ..... F24C 3/12
10,215,809 B2 * 2/2019 Mills ..... G01R 31/3278
2002/0099474 A1 7/2002 Khesin
2003/0222982 A1 12/2003 Hamdan et al.
2004/0209209 A1 10/2004 Chodacki et al.
2005/0086341 A1 4/2005 Enga et al.
2005/0092851 A1 5/2005 Troost et al.
2006/0257801 A1 11/2006 Chian
2006/0257802 A1 11/2006 Chian et al.
2006/0257804 A1 11/2006 Chian et al.
2006/0257805 A1 11/2006 Nordberg et al.
2007/0159978 A1 7/2007 Anglin et al.
2007/0188971 A1 8/2007 Chian et al.
2007/0207422 A1 9/2007 Cueva
2008/0266120 A1 10/2008 Leeland et al.
2009/0009344 A1 1/2009 Chian
2009/0136883 A1 5/2009 Chian et al.
2010/0013644 A1 1/2010 McDonald et al.
2010/0265075 A1 10/2010 Chian
2012/0288806 A1 * 11/2012 Racaj ..... F23N 5/123 431/18
2016/0091204 A1 * 3/2016 Patton ..... G05B 19/054 700/274
2016/0091205 A1 3/2016 Solosky et al.
2016/0091903 A1 3/2016 Patton et al.
2016/0092388 A1 3/2016 Sorenson et al.
2016/0098055 A1 4/2016 Solosky et al.
2016/0123624 A1 5/2016 Solosky

OTHER PUBLICATIONS

Honeywell, "SV9410/SV9420; SV9510/SV9520; SV9610/SV9620 SmartValve System Controls," Installation Instructions, 16 pages, 2003.

www.playhookey.com, "Series LC Circuits," 5 pages, printed Jun. 15, 2007.

* cited by examiner

FLAME SENSE CIRCUIT WITH VARIABLE BIAS

BACKGROUND

The present disclosure pertains to sensing circuits for diagnostic and other purposes.

SUMMARY

The disclosure reveals changing a bias level of the flame sensing circuit to identify leakage in the flame sensing circuit. The bias level may be varied in the positive or negative axis and the flame current may be noted to identify leakage. The bias level may be changed by a microcontroller. The bias level may be changed using an operational amplifier configuration which is used as a signal conditioner for interfacing the flame signal to the microcontroller.

DESCRIPTION

The present system and approach may incorporate one or more processors, computers, controllers, user interfaces, wireless and/or wire connections, and/or the like, in an implementation described and/or shown herein.

This description may provide one or more illustrative and specific examples or ways of implementing the present system and approach. There may be numerous other examples or ways of implementing the system and approach.

The disclosure reveals changing the bias level of the flame sensing circuit to identify leakage in the flame sensing circuit. The bias level may be varied in the positive or negative axis and the flame current may be noted to identify leakage. The bias level may be changed by a microcontroller. The bias level may be changed using an operational amplifier configuration which is used as a signal conditioner for interfacing the flame signal to the microcontroller.

Flame sense circuits may generally work with very low level signals. These signals may be very sensitive to various parasitic effects such as moisture pollution of circuit boards, causing various current leakages, and so on. The parasitic signals may cause either reduced flame detection circuit sensitivity or (which may be worse) the parasitic signals may appear as a non-existing flame (false flame).

Figure 1:
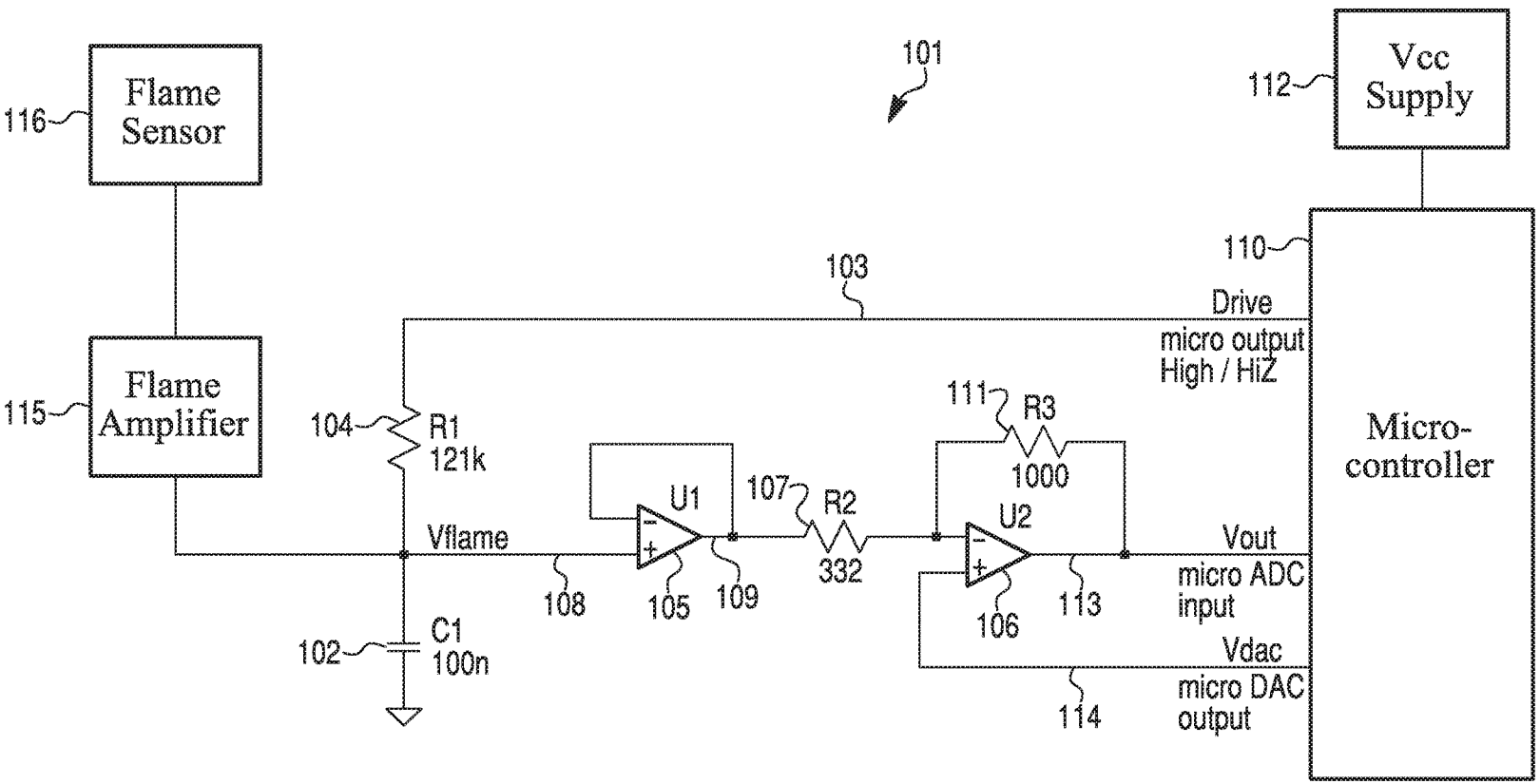
FIG. 1 is a diagram of a flame sense circuit for measuring a flame sensing signal with a variable bias voltage.

The critical high impedance node is the input on a line 108 to capacitor (C1) 102 (labeled Vflame) in a circuit of FIG. 1. A voltage at this node may be controlled to stay within +/−50 mV centered at 0V (i.e., its mean voltage=0V). That said, the amount of current "stolen" by leakage at +50 mV cycle may be "returned back" with a −50 mV cycle; thus, it is somewhat self-compensating. However, the same leakage across capacitor 102 in the present circuit has no necessary impact on flame current measurement.

Circuit 101 does not necessarily need to "measure the leakage" to calculate the flame current. The flame current may be simply calculated as a "single step"; that is, keeping the Vflame signal within +/−50 mV range centered around 0V may be the only thing that is needed to calculate the flame current.

In circuit 101, one may keep the same voltage thresholds at a microcontroller ADC input (i.e., 350 mV and 650 mV thresholds at the ADC input may cause Vflame to stay within a +/−50 mV window centered around 0V, if the micro DAC output reference voltage is 125 mV, R1=332 ohms, R2=1000R).

In case the DAC reference voltage is changed from 125 mV to 275 mV, the Vflame voltage at capacitor 102 may move to +/−50 mV centered around +200 mV (that is, the Vflame may bounce within a +150 mV and +250 mV window in this case). That means, the Vflame may be about +200 mV higher, while the ADC control thresholds (350 mV and 650 mV) may be kept the same.

Also the flame current calculation should lead to the identical flame current value in the event that leakage is not present. If the leakage is present, the currents calculated will be different and that is a way how leakage may be detected. A principle may be that capacitor 102 is discharged by a flame current and charged back by a duty-cycle signal.

However, if leakage is present while the bias is positive, then the leakage may act as a false flame which is to be prevented.

The present flame sense circuit 101 may bias the flame signal to various voltage levels, i.e., positive, negative or neutral (0V) voltage bias (which may be a feature). A flame signal may be measured at each bias level and compared with the measurements at other bias levels. The measurements at all bias levels should lead to identical flame signal strength measurements under normal operating conditions.

Parasitic effects such as the moisture pollution may cause the measurements at various bias levels to differ from each other. Often the greater bias voltages (either positive or negative) may be more sensitive to parasitic effects. The parasitic effects may be detected this way.

Figure 2:
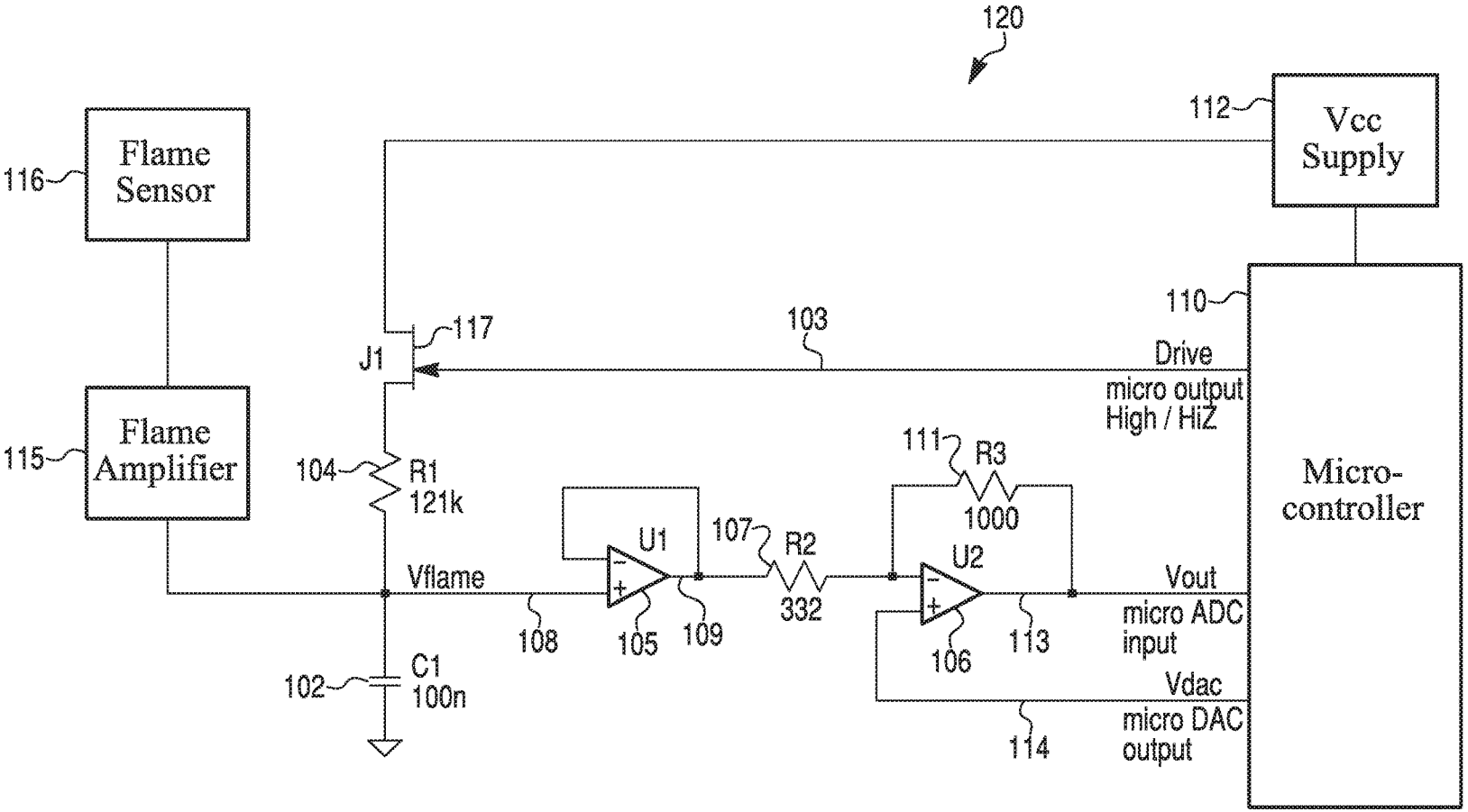
FIG. 2 is a diagram like that of FIG. 1 but has a different connection to a drive pin of a microcontroller.

FIG. 1 is a diagram of a flame sense circuit 101. Storage capacitor (C1) 102 may be discharged by a negative flame current. A voltage at capacitor 102 (referenced as 'Vflame') may be controlled to stay within a defined voltage range, i.e., from −50 mV to +50 mV. The voltage may be controlled by a microcontroller 110 'Drive' output pin 103 in the following fashion. Drive pin 103 may turn to an Output-High state whenever Vflame is lower than the −50 mV threshold. A microcontroller 110 may start to charge capacitor 102 thru resistor (R1) 104 from its Vcc supply 112. Drive pin 103 may turn to a Hi-Z (high impedance) state whenever Vflame exceeds a +50 mV threshold. Alternatively, resistor 104 may not necessarily be connected to microcontroller Drive pin 103, but the resistor 104 can be connected to switch, such as a FET transistor 117 as shown in a circuit 120 in FIG. 2. The other side of the switch 117 may be connected to microcontroller voltage supply (Vcc) 112. Switch 117 may be controlled by the microcontroller Drive pin 103.

The flame current may be proportional to a Drive pin duty cycle.

The Vflame voltage on line 108 may be interfaced to microcontroller 110 by means of two operational amplifiers 105 and 106. An output 109 of amplifier 105 may be connected back to an inverting input of amplifier (U1) 105. Output 109 from an operational amplifier 105 may be connected to an inverting input of an operational amplifier (U2) 106 via a resistor 107. Resistor 107 may have a value of 332 Ohms or another appropriate value. Operational amplifier 105 may be a buffer that decouples a high impedance flame signal on line 108 from operational amplifier 106. Amplifier 106 may be an inverting operational amplifier that conditions Vflame signal from output 109 to levels on output 113 of amplifier 106 suitable for readings to a micro analog-to-digital converter (ADC) of microcontroller 110. Amplifier 106 may have a connection through a feedback resistor (R3) 111 from output 113 to inverting input of amplifier 106. Resistor 111 may have a value of 1 k Ohms or another appropriate value. The Vflame may be multiplied by factor of −R3/R2 (e.g., −3.0) or other factor. A DC bias voltage may be added to the Vflame so that an output voltage, 'Vout' on line 113, fits well within a microcontroller ADC reading range (i.e., centered around 500 mV or, i.e., microcontroller Vcc/2). The DC bias voltage on line 114 may be defined by 'Vdac', i.e., a microcontroller DAC output. Alternatively, a simple voltage divider network or microcontroller pulse width modulated (PWM) output may be utilized for the same purpose. There should be two voltage thresholds for Vout on line 113 that correspond to the Vflame thresholds of, for instance, +50 mV and −50 mV. One may call the thresholds "Vout_thr_a" and "Vout_thr_b", respectively. Microcontroller 110 may continuously measure Vout voltage on line 113 and control Drive pin 103 accordingly, so that the Vout on line 113 stays within the range defined by the Vout_thr_a and Vout_thr_b thresholds, and which may result in the Vflame signal to stay in the +/−50 mV range, as an example. Equations further describing the present circuit, threshold examples, and so forth may be found herein.

Microcontroller 110 may change or adjust the Vdac reference voltage on line 114, while keeping the same Vout_thr_a and Vout_thr_b thresholds. An adjustment on line 114 may add a DC voltage bias to the Vflame voltage. For instance, a certain increase of a Vdac reference voltage could add +200 mV thus shifting the original +/−50 mV peak-to-peak Vflame effectively to have +150 mV and +250 mV thresholds. The flame current of the peak-to-peak Vflame signal measured (or calculated) at this new bias level should stay the same as before. If leakage (due to, for example, moisture pollution, and so forth) is present in the flame sense circuitry, it may leverage heavily the measurements at the +200 mV Vflame bias. The leakage current may be discovered in view of different flame current readings at different bias voltage levels.

The way of changing the bias levels to discover/identify leakage may be a feature of the present system and approach. One may note that Vflame may be biased with negative voltage also for more complex diagnostics. Readings with 0V bias (corresponding to the initial +/−50 mV Vflame threshold) may be the least sensitive to the leakage in comparison to a non-0V bias. The sensitivity to the leakage may increase with the added bias (in both directions, i.e., either negative or positive).

Flame sense circuit 101 with a variable bias voltage may be described from a more mathematical perspective in context of FIG. 1. A flame current signal (from a flame amplifier 115 that amplifies the flame signal from flame sensor 116) may sink current from a 100 nf capacitor (C1) 102, thus discharging the capacitor 102. Microcontroller 110 may charge back capacitor 102 by means of a controlling "Drive" pin 103 that can be set either as an Output-High or Hi-Z. The speed of the charge depends on resistor (R1) 104, Vflame, and microcontroller supply voltage, Vcc 112. Resistor 104 may be, for example, 121 k ohms. A greater flame current may mean that capacitor 102 needs to be recharged (by microcontroller) more frequently, or with a greater duty cycle. In fact, circuit 101 may convert flame current to a duty cycle measurement in conjunction with microcontroller 110. Flame current may be easily determined with a duty cycle.

The circuit may allow for a simple leakage detection. Vflame to be kept centered around 0V with a small voltage ripple (e.g., +/−50 mV ripple). A small working voltage may mean low leakage impact; parasitic resistance from Vflame to GND may reduce circuit sensitivity rather than create a false flame.

However, Vflame voltage may be easily shifted up or down with a defined bias voltage by means of changing a Vdac reference voltage on line 114 from the output of the DAC of microcontroller 110. Greater (either positive or negative) bias voltage may mean the circuit of Vflame capacitor 102 may be much more sensitive to leakages (and also possibly sensitive to a false flame). But flame strength measurements at various bias levels shall match each other indicating no leakage current. Should the measurements vary at different bias levels, leakage current may be present in the circuit.

A circuit built around amplifier 106 may be described by the equation:

$$(V\text{dac}-V\text{flame})/R2=(V\text{out}-V\text{dac})/R3 \quad (1),$$

thus, $$V\text{dac}=(R2\times V\text{out}+R3\times V\text{flame}\}/(R2+R3) \quad (2)$$

and $$V\text{out}=V\text{dac}+(R3/R2)(V\text{dac}-V\text{flame}). \quad (3)$$

Since Vflame=Vflame_bias+Vflame_ripple, one may write $$V\text{out}=V\text{dac}+(R3/R2)(V\text{dac}-V\text{flame_bias}-V\text{flame_ripple}). \quad (4)$$

One may calculate Vdac bias voltages for three different Vflame biases. There may be also two Vout thresholds for each Vdac bias level. One may assume +/−50 mV flame voltage ripple (Vlflame_rip) for each bias level. One may want to have Vout centered around 500 mV (=Vout_nom) for all measurements.

Circuit component values may include C1=100 uF, Vcc=3.3V, R1=121 kOhm, Vout_nom=500 mV, R2=332 Ohm, Vflame_ripple=50 mV, and R3=1000 ohm. The components may have other values as appropriate.

1) Vflame mean=0V; +/−50 mV flame ripple may be noted.

One may calculate Vdac voltage from [2], where Vout=Vout_nom=500 mV and Vflame=0V: Vflame_bias_0=0

$$V\text{dac_0}=(R2\times V\text{out_nom}+R3\times V\text{flame_bias_0})/(R2+R3)=125\text{ mV} \quad [2.1]$$

Now one may put +50 mV and −50 mV flame ripple to [4];

$$V\text{out_0}p=V\text{dac_0}+(R3/R2)(V\text{dac_0}-V\text{flame_bias_0}-V\text{flame_ripple})=349\text{ mV}; \quad [4.1]$$

$$\text{and } V\text{out_0}n_V\text{dac_0}=(R3/R2)(V\text{dac_0}-V\text{flame_bias_0}+V\text{flame ripple})=651\text{ mV} \quad [4.2]$$

How to understand this approach may be noted in the following.

Vflame may be regulated to stay within +50 mV to −50 mV range so that the microcontroller provides a 125 mV reference voltage (to amplifier 106) at its DAC output, and may regulate capacitor 102 charge by means of controlling a Drive pin so that Vout stays within a 349 mV to 651 mV range.

(The microcontroller may turn the Drive pin High when Vout reaches 651 mV [which corresponds to the Vflame=−50 mV]. Drive pin 103 may be turned to HiZ at the moment when Vout reaches 349 mV [which corresponds to Vflame=+50 mV].

One may calculate new thresholds for the same flame voltage ripple but use+200 mV Vflame bias now:

2) Vflame mean=200 mV; +/−50 mV flame ripple may be noted.

Again, using [2], where Vout=Vout_nom=500 mV, but Vflame=200 mV;

Vflame_bias 2$p$=0.2;

$$Vdac_2p=(R2\times Vout_nom+R3\times Vflame_bias_2p)/(R2+R3)=275\text{ mV}. \quad [2.2]$$

One may keep the same +50 mV and −50 mV flame ripple and put it back again to [4]:

$$Vout_2p=Vdac_2p+(R3/R2)(Vdac_2p-Vflame_bias_2p-Vflame_ripple)=349\text{ mV}; \quad [4.3]$$

$$Vout_2n-Vdac_2p+(R3/R2)(Vdac_2p-Vflame_bias_2p+Vflame_ripple)=651\text{ mV}; \quad [4.4]$$

As can be seen, [4.3] may provide the same threshold as [4.1] and [4.4] as [4.2], respectively. Just the DAC bias voltage may change from 125 mV [2.1] to 275 mV [2.2]. That appears good in that one may keep the same +/−50 mV flame voltage ripple (just DC shifted about 200 mV) while having the Vout readings centered around 1.5 V.

One may now calculate Vdac for −100 mV Vflame bias.

3) Vflame mean=−100 mV; +/−50 mV flame ripple may be noted.

$$Vflame_bias_2n=-100\text{ mV}$$

$$Vdac_2n=(R2\times Vout_nom+R3\times Vflame_bias_2n)/(R2+R3)=50\text{ mV} \quad [2.3]$$

One does not necessarily need to calculate Vout thresholds any more since they have already been calculated above; see [4.1], [4.3], [4.2], and [4.4].

One has calculated two Vout thresholds, the Vout_0p [4.1] and Vout_0n [4.2]. As already mentioned, the microcontroller may control the Vout voltage to stay between these thresholds (turning Drive output High when the Vout goes above Vout_0n {charging C1 through R1 . . . } and turning to Drive HiZ when the Vout falls below Vout_0p {capacitor 102 charge complete}.

The microcontroller may run this routine for three different Vflame bias voltages so that it sets up three different Vdac reference voltages to operational amplifier 106.

The microcontroller may measure a time when the Drive output is High and HiZ. The "Drive High" duty cycle may need to be calculated as:

$$Dhigh=Thigh/(Thigh+Thiz), \quad [5]$$

where Thigh is the time when Drive pin is driven to Output High, and Thiz is the time when Drive pin is driven to HiZ (high impedance).

The Dhigh duty cycle may be different for each Vflame bias voltage. That may be good in that capacitor 102 is always charged from a Vcc supply source (microcontroller supply voltage) thru resistor 104. Greater bias voltage may mean a lower voltage drop across resistor 104; thus, it takes a longer time to charge the capacitor.

The microcontroller may periodically replenish an amount of charge to capacitor 102 which is (continuously) drained by flame current. One may calculate the flame current as:

$$Iflame=((Vcc-Vflame_bias)/R1)\times Dhigh \quad [6]$$

One may note that equation [6] appears somewhat simplified. The capacitor may be charged from (Vflame_bias−Vflame_ripple) to (Vflame_bias+Vflame_ripple). The mean value may apparently be Vflame_bias (that may work well for Vripple<<Vcc).

[That being said, the Dhigh duty cycle is not necessarily a function of Vripple.]

A duty cycle may be expressed from [6] as $$Dhigh=(Iflame\times R1)/(Vcc-Vflame_bias) \quad [7]$$

For example, one may assume a 1 uA flame current. Then one can ask what the differences are among the duty cycles for all three bias voltages calculated above.

Iflame=1 uA

Dhigh_0=(IflameR1/(Vcc—Vflame_bias_0))100=3.667[%]

Dhigh_2$p$=(IflameR1/(Vcc−Vflame_bias_2$p$))100=3.903 [%]

Dhigh_2n=(IflameR1/(Vcc−Vflame_bias_2n))100=3.559 [%]

To recap, an approach for determining a condition of a flame sense signal may incorporate detecting a high impedance flame signal from one or more devices selected from a group including a flame sensor and a flame amplifier, buffering the high impedance flame signal to decouple the high impedance or low current flame signal from a biasing circuit, biasing a buffered flame signal at a first voltage from a microcontroller, measuring the buffered flame signal biased at the first voltage, biasing the buffered flame signal at a second voltage from the microcontroller, measuring the buffered flame signal biased at the second voltage, and comparing a measured buffered flame signal biased at the first voltage with a measured buffered flame signal biased at the second voltage. High impedance may mean an impedance greater than 200K Ohms. Low current may mean a current lower than 50 micro-Amperes.

If the measured buffered flame signal biased at the first voltage is equal to the measured buffered flame signal biased at the second voltage, then the buffered flame signal may be free from current leakage.

If the measured buffered flame signal biased at the first voltage is different from the measured buffered flame signal biased at the second voltage, then the buffered flame signal might not necessarily be free from current leakage.

If the measured buffered flame signal biased at the first voltage and the measured buffered flame signal biased at the second voltage have a greater than a predetermined X percent difference from each other, then current leakage from the flame signal may be occurring.

If a difference between the measured buffered flame signal, biased at the first voltage, and the measured buffered flame signal, biased at the second voltage, increases, then the accuracy of the flame signal may decrease.

A flame sense circuit may incorporate a capacitor having a first terminal for connection to a flame amplifier, a first amplifier having an input connected to the first terminal of the capacitor, and a second amplifier having input connected to an output of the first amplifier, having an output connectable to an input terminal of a microcontroller, and having a second input connectable to a first output terminal of the microcontroller. The first terminal of the capacitor may be connectable to a second output terminal of the microcontroller, or to a switching element controlled by the microcontroller.

The input terminal of the microcontroller may be to an analog to digital converter, or an analog comparator. The first output terminal of the microcontroller may be connected to a digital to analog converter (DAC), or to a pulse width modulated (PWM) signal generator. The second output terminal of the microcontroller may be for providing a drive signal that directly controls a charge to the capacitor or controls a switch that controls the charge to the capacitor.

The capacitor may be discharged by a flame current signal of the flame amplifier. The flame current signal may have a negative mean value.

The capacitor may be recharged by the drive signal from the second output terminal of the microcontroller, or the capacitor may be recharged by the switch controlled by the second output of the microcontroller.

The first output terminal of the microcontroller may provide a bias voltage to the second input of the second amplifier.

The flame current signal may be provided to the input of the first amplifier.

The flame current signal may become a biased flame current signal by the bias voltage from the first output terminal of the microcontroller provided to the second input of the second amplifier.

The biased flame current signal may go to the input terminal of the microcontroller that is to the analog to digital converter.

The biased flame current signal may be measured at two or more magnitudes of bias voltage from the first output terminal of the microcontroller provided to the second input of the second amplifier.

The microcontroller may measure magnitudes of the flame current signal at each of the two or more magnitudes of bias voltage. If the magnitudes of the flame current signal at each of the two or more magnitudes of bias voltage are the same, then there may be no leakage of current from the flame current signal of the flame amplifier. If the magnitudes of the flame current signals at each of the two or more magnitudes, respectively, of bias voltage are the same, then there may be no leakage of current from the flame current signal of the flame amplifier.

The microcontroller may determine a magnitude of the drive signal needed to recharge the capacitor, due to the flame current signal, to the input terminal of the microcontroller, in accordance with an algorithm.

The drive signal may have a duty cycle that is varied by the microcontroller according to the algorithm to provide an appropriate magnitude needed to recharge the capacitor by determining an amount of charge removed from the capacitor from an analysis of the flame current signal, and setting the duty cycle.

A system for determining a quality of a flame sensing signal, may incorporate a capacitor connectable to a flame amplifier or flame sensor, an interface circuit having an input connected to the capacitor, and a microcontroller having an input connected to an output of the interface circuit, a first output connected to the interface circuit, and a second output connected to the capacitor. The interface circuit may provide a connection between the capacitor and the microcontroller that compensates for a difference of an impedance at the capacitor and the impedance at the input of the microcontroller. The first output from the microcontroller may provide a voltage to the interface circuit for biasing a flame detection signal to the input of the microcontroller. The second output from the microcontroller may provide a drive signal that recharges the capacitor having at least some discharge caused by an occurrence of the flame detection signal at the capacitor.

Various magnitudes of voltage from the first output from the microcontroller may bias the flame detection signal to the input of the microcontroller. A magnitude of the flame detection signal may be measured by the microcontroller to determine whether the magnitude of the flame detection signal changes with various magnitudes of voltage biasing the flame detection signal.

If the magnitude of the flame detection signal changes with various magnitudes of voltage biasing the flame detection signal, then there may be current leakage. If the magnitude of the flame detection signal remains the same with various magnitudes of voltage biasing the flame detection signal, then there may be an absence of current leakage.

U.S. Pat. No. 7,800,508, issued Sep. 21, 2010, is hereby incorporated by reference.

In the present specification, some of the matter may be of a hypothetical or prophetic nature although stated in another manner or tense.

Although the present system and/or approach has been described with respect to at least one illustrative example, many variations and modifications will become apparent to those skilled in the art upon reading the specification. It is therefore the intention that the appended claims be interpreted as broadly as possible in view of the related art to include all such variations and modifications.

What is claimed is:

1. A method for determining a condition of a flame sense signal comprising:

detecting a high impedance flame signal from one or more devices selected from a group comprising a flame sensor and a flame amplifier;

buffering the high impedance flame signal to decouple the high impedance or low current flame signal from a biasing circuit;

biasing a buffered flame signal at a first voltage from a microcontroller;

measuring the buffered flame signal biased at the first voltage;

biasing the buffered flame signal at a second voltage from the microcontroller;

measuring the buffered flame signal biased at the second voltage; and comparing a measured buffered flame signal biased at the first voltage with a measured buffered flame signal biased at the second voltage; and wherein high impedance means an impedance greater than 200K ohms; and wherein low current means a current lower than 50 micro-Amperes.

2. The method of claim 1, wherein if the measured buffered flame signal biased at the first voltage is equal to the measured buffered flame signal biased at the second voltage, then the buffered flame signal is free from current leakage.

3. The method of claim 1, wherein if the measured buffered flame signal biased at the first voltage is different from the measured buffered flame signal biased at the second voltage, then the buffered flame signal is not necessarily free from current leakage.

4. The method of claim 1, wherein if the measured buffered flame signal biased at the first voltage and the measured buffered flame signal biased at the second voltage have a greater than a predetermined X percent difference from each other, then current leakage from the flame signal is occurring.

5. The method of claim 1, wherein if a difference between the measured buffered flame signal, biased at the first voltage, and the measured buffered flame signal, biased at the second voltage, increases, then the accuracy of the flame signal decreases.

6. A system for determining a quality of a flame sensing signal, comprising:

a capacitor connectable to a flame amplifier or flame sensor;

an interface circuit having an input connected to the capacitor; and a microcontroller having an input connected to an output of the interface circuit, a first output connected to the interface circuit, and a second output connected to the capacitor; and wherein:

the interface circuit provides a connection between the capacitor and the microcontroller that compensates for a difference of an impedance at the capacitor and the impedance at the input of the microcontroller;

the first output from the microcontroller provides a voltage to the interface circuit for biasing a flame detection signal to the input of the microcontroller; and the second output from the microcontroller provides a drive signal that recharges the capacitor having at least some discharge caused by an occurrence of the flame detection signal at the capacitor.

7. The system of claim 6, wherein:

various magnitudes of voltage from the first output from the microcontroller bias the flame detection signal to the input of the microcontroller; and a magnitude of the flame detection signal is measured by the microcontroller to determine whether the magnitude of the flame detection signal changes with various magnitudes of voltage biasing the flame detection signal.

8. The circuit of claim 7, wherein:

if the magnitude of the flame detection signal changes with various magnitudes of voltage biasing the flame detection signal, then there is current leakage; and if the magnitude of the flame detection signal remains the same with various magnitudes of voltage biasing the flame detection signal, then there is an absence of current leakage.

* * * * *